US005870127A

United States Patent [19]

Koike et al.

[11] Patent Number: 5,870,127

[45] Date of Patent: Feb. 9, 1999

[54] RECORDING APPARATUS

[75] Inventors: Yasushi Koike, Kawasaki; Nozomu Nishiberi, Yokohama, both of Japan

[73] Assignee: Canon Kabushiki Kaisha, Tokyo, Japan

[21] Appl. No.: 690,392

[22] Filed: Jul. 26, 1996

[30] Foreign Application Priority Data

Jul. 27, 1995 [JP] Japan ..... 7-211064

[51] Int. Cl.[6] ..... B41J 2/01

[52] U.S. Cl. ..... 347/104; 400/634

[58] Field of Search ..... 347/104; 346/134; 400/634, 636, 567, 571, 605

[56] References Cited

U.S. PATENT DOCUMENTS 4,821,049 4/1989 Eckl ..... 346/134

5,291,224 3/1994 Asano et al. ..... 347/104

5,719,611 2/1998 Nakamura et al. ..... 347/103

5,731,829 3/1998 Saito et al. ..... 347/104

*Primary Examiner*—Benjamin R. Fuller

*Assistant Examiner*—Thien Tran

*Attorney, Agent, or Firm*—Fitzpatrick, Cella, Harper & Scinto

[57] ABSTRACT

A recording apparatus which includes a first and second discharge members located downstream from a recording head for discharging a sheet, and first and second auxiliary discharge members also located downstream from the recording head for discharging the sheet, where the first and second auxiliary discharge members are urged against the first and second discharge members, respectively, at a first position, and where the first auxiliary discharge member is substantially urged against the second discharge member at a second position.

19 Claims, 11 Drawing Sheets

RECORDING APPARATUS

BACKGROUND OF THE INVENTION

1. Field of the Invention

The present invention relates to a recording apparatus for recording an image by discharging ink from a recording means onto a recording medium.

2. Related Background Art

In recording apparatuses having printer, copier and/or facsimile functions or in recording apparatuses used as an output device for a work station or a composite equipment including a computer, a word processor and the like, an image is recorded on a recording medium such as a sheet or a thin plastic film (for example, an OHP sheet) in response to image information. The recording apparatuses are divided into an ink jet recording apparatus, a wire dot recording apparatus, a heat-sensitive recording apparatus, a heat transfer recording apparatus and a laser beam recording apparatus, in accordance with a recording fashion of a recording means.

Among these recording apparatuses, the ink jet recording apparatus is designed so that the recording is effected by discharging ink from a recording means (recording head) onto a recording medium and has advantages that the recording means can easily be made compact, that a finer image can be recorded at a high speed, that the image can be recorded on a plain sheet without any specific treatment, that a running cost is inexpensive, that noise can be extremely reduced because of non-impact recording, and that a color image can easily be formed by using different color inks. Among the ink jet recording apparatus, a recording apparatus of line type having a line type recording head in which a plurality of ink discharge openings are disposed along a width-wise direction of the recording medium permits further high speed recording.

Particularly, in an ink jet recording means (recording head) for discharging the ink by utilizing energy, since the high density liquid passage arrangement (ink discharge opening arrangement) can easily be achieved by forming electro-thermal converter disposed on a substrate, electrodes, liquid passage walls and a top plate by semiconductor manufacturing process such as etching, deposition, spattering and the like, further compactness of the recording means can be expected.

Now, a main construction of the above-mentioned ink jet recording apparatus will be explained with reference to FIG. 10. A recording medium (not shown) is pinched between a convey roller (convey means) 105 and a feed roller 106 and is conveyed by these rollers. When the recording medium reaches a recording position, in response to a signal emitted from a head cartridge (recording means) 101 situated at the recording position, ink is discharged from the head cartridge, thereby effecting the recording. Then, the recording medium is further conveyed by a pair of feed rollers 110, 111 and then is discharged out of the apparatus by a pair of discharge rollers 112, 113 disposed at a downstream side of the pair of feed rollers 110, 111 in a recording medium conveying direction.

In the above-mentioned conventional ink jet recording apparatus, the pair of feed rollers comprise a feed roller (first discharge means) 110 and spurs (first auxiliary discharge means) 111 urged against the feed roller 110, and the pair of discharge rollers comprise a sheet discharge roller (second discharge means) 112 and spurs (second auxiliary discharge means) 113 urged against the sheet discharge roller 112, and the spurs 111, 113 are disposed on a cover 115 which can be opened and closed with respect to a body of the apparatus. Each spur is a wheel provided at its periphery with a plurality projections each having a sharp tip end so that the recording medium can be discharged (or conveyed) by one or more projections (with very small contact area).

In the above-mentioned apparatus, when the head cartridge 101 is exchanged to a new one due to consumption of ink, the cover 115 is opened by pivoting the cover in an anti-clockwise direction as shown in FIG. 11, thereby permitting the exchange of the head cartridge 101. If the cover 115 is opened by pivoting the cover in a clockwise direction in FIG. 11, the spurs 111 with interfere with the head cartridge 101. Further, in the above-mentioned apparatus, a panel set substrate 120 on which an LCD 121 is disposed is secured at a left portion (FIG. 11) of the apparatus. Accordingly, an operator is in a left side of the recording apparatus.

In the above-mentioned relation, when the cover 115 is opened as shown in FIG. 11, the head cartridge must be exchanged across the opened cover 115. Further, when the panel operation is effected in order to shift the head cartridge 101 to an appropriate position to facilitate the exchange of the head cartridge, since the head cartridge 101 is concealed by the cover 115, the operation is hard to be effected.

Further, when the head cartridge 101 is exchanged after the cover 115 is dismounted from the apparatus, if the spurs 111, 113 are subjected to an external force, the water repelling ability of the spurs 111, 113 will be reduced, with the result that the ink adhered to the spurs is re-transferred to the recording medium, thereby deteriorating the recording quality.

In the above-mentioned conventional technique, if the cover 115 is opened while the recording is being effected, since the urging force of the spurs 111 acting on the platen is released, the recording medium will be stopped at a downstream side of the convey roller 105.

SUMMARY OF THE INVENTION

A first object of the present invention is to provide a recording apparatus in which the recording and conveyance of a recording medium can be effected even in a condition that a cover is opened with respect to a body of the recording apparatus, regardless of the kind of recording medium (for example, a single recording sheet or a continuous recording web).

A second object of the present invention is to provide a recording apparatus in which, in a condition that a cover is opened with respect to a body of the recording apparatus, electric stability (grounding and the like) of elements moved in synchronous with the opening movement of the cover can be ensured.

To achieve the above first object of the present invention, according to the present invention, there is provided a recording apparatus which comprises a recording means for effecting the recording regarding a recording medium, a convey means for conveying the recording medium, a first discharge means disposed in the vicinity of the recording means at a downstream side of the recording means in a recording medium conveying direction, a second discharge means at a downstream side of the first discharge means in the recording medium conveying direction, and first and second auxiliary discharge means urged against the first and second discharge means, respectively, at a first position. It further comprises a second position where the second discharge means and the first auxiliary discharge means are urged against each other.

The recording apparatus having the above-mentioned arrangement may comprise a guide member for shifting the first auxiliary discharge means from the first position to the second position in a direction substantially parallel to the recording medium conveying direction. The first and second auxiliary discharge means may include urging force applying means for urging the first and second auxiliary discharge means against the first and second discharge means, independently, and the recording means may be of type wherein the recording regarding the recording medium is effected by discharging ink.

Further, in the recording apparatus wherein the recording is effected by discharging ink, the first and second auxiliary discharge means may comprise rotary members, respectively, and may include corresponding cleaning means independently, and the recording means may include electro-thermal converter for generating thermal energy causing film boiling in the ink as an element for generating energy utilized to discharge the ink.

The present invention further provides a recording apparatus which comprises a recording means for effecting the recording regarding a recording medium, a convey means for conveying the recording medium, a first discharge means disposed in the vicinity of the recording means at a downstream side of the recording means in a recording medium conveying direction, a second discharge means at a downstream side of the first discharge means in the recording medium conveying direction, first and second auxiliary discharge means urged against the first and second discharge means, respectively, at a first position, a second position where the second discharge means and the first auxiliary discharge means are urged against each other, and a guide member for shifting the first auxiliary discharge means from the first position to the second position in a direction substantially parallel to the recording medium conveying direction. It further comprises a cover supported by the recording apparatus for an opening/closing movement with respect to the recording apparatus, and a holding means adapted to rotatably hold the first and second auxiliary discharge means and operated in synchronous with the cover.

In this recording apparatus, the first and second auxiliary discharge means may include urging force applying means for urging the first and second auxiliary discharge means against the first and second discharge means, independently and the recording means may be of type wherein the recording regarding the recording medium is effected by discharging ink.

Further, in the recording apparatus wherein the recording is effected by discharging ink, the first and second auxiliary discharge means may comprise rotary members, respectively, and may include corresponding cleaning means independently, and the recording means may include electro-thermal converter for generating thermal energy causing film boiling in the ink as an element for generating energy utilized to discharge the ink.

To achieve the above second object of the present invention, according to the present invention, there is provided a recording apparatus which comprises a recording means for effecting the recording regarding a recording medium, a convey means for conveying the recording medium, a first discharge means disposed in the vicinity of the recording means at a downstream side of the recording means in a recording medium conveying direction, a second discharge means at a downstream side of the first discharge means in the recording medium conveying direction, first and second auxiliary discharge means urged against the first and second discharge means, respectively, at a first position, a second position where the second discharge means and the first auxiliary discharge means are urged against each other, a guide member for shifting the first auxiliary discharge means from the first position to the second position in a direction substantially parallel to the recording medium conveying direction, a cover supported by the recording apparatus for an opening/closing movement with respect to the recording apparatus, and a holding means adapted to rotatably hold the first and second auxiliary discharge means and operated in synchronous with the cover. It further comprising a metal frame on which the first and second discharge means and the convey means are rested, and wherein the holding means and the metal frame are electrically connected to each other through the guide member both in the first and second positions.

In this recording apparatus, the first and second auxiliary discharge means may include urging force applying means for urging the first and second auxiliary discharge means against the first and second discharge means, independently, and the recording means may be of type wherein the recording regarding the recording medium is effected by discharging ink.

Further, in the recording apparatus wherein the recording is effected by discharging ink, the first and second auxiliary discharge means may comprise rotary members, respectively, and may include corresponding cleaning means independently, and the recording means may include electro-thermal converter for generating thermal energy causing film boiling in the ink as an element for generating energy utilized to discharge the ink.

In the present invention for achieving the above first object, since the second discharge means and the first auxiliary discharge means are substantially urged against each other at the second position, when the condition that the cover is opened is assumed to the second position, also in the condition that the cover is opened, the recording medium can be conveyed by the second discharge means and the first auxiliary discharge means, regardless of the kind of the recording medium. By providing the guide member for shifting the first auxiliary discharge means from the first position to the second position in the direction substantially parallel to the recording medium conveying direction, even when the cover is opened, a bad influence is not affected upon the conveyance of the recording medium, thereby obtaining the good recording result.

Further, by providing the holding means adapted to rotatably hold the first and second auxiliary discharge means and operated in synchronous with the cover pivotally supported by the recording apparatus, when the cover is opened, since the second position is obtained by the holding means in synchronous with the cover, the operability is improved. In addition, in the present invention for achieving the above second object, since the metal frame on which the first and second discharge means and the convey means are rested is provided, and the holding means and the metal frame are electrically connected to each other through the guide member both in the first and second positions, even when the cover is opened, the electrical stability of the holding means driven in synchronous with the opening movement of the cover can be ensured.

In addition, since the urging force applying means for urging the first and second auxiliary discharge means against the first and second discharge means, independently, are provided, the first and second auxiliary discharge means can surely convey the recording medium in the first and second positions.

Further, since the first and second auxiliary discharge means comprise rotary members, respectively, and are cleaned by the corresponding cleaning means independently, even when the recording means effects the recording by discharging the ink toward the recording medium, the ink is not re-transferred to the recording medium, thereby preventing the deterioration of the recording quality. In addition, since the recording means includes the electro-thermal converter for generating the thermal energy causing the film boiling in the ink as the element for generating energy utilized to discharge the ink, the discharging of the ink toward the recording medium is performed effectively, thereby obtaining a good recording result.

DETAILED DESCRIPTION OF PREFERRED EMBODIMENTS

Figure 1:
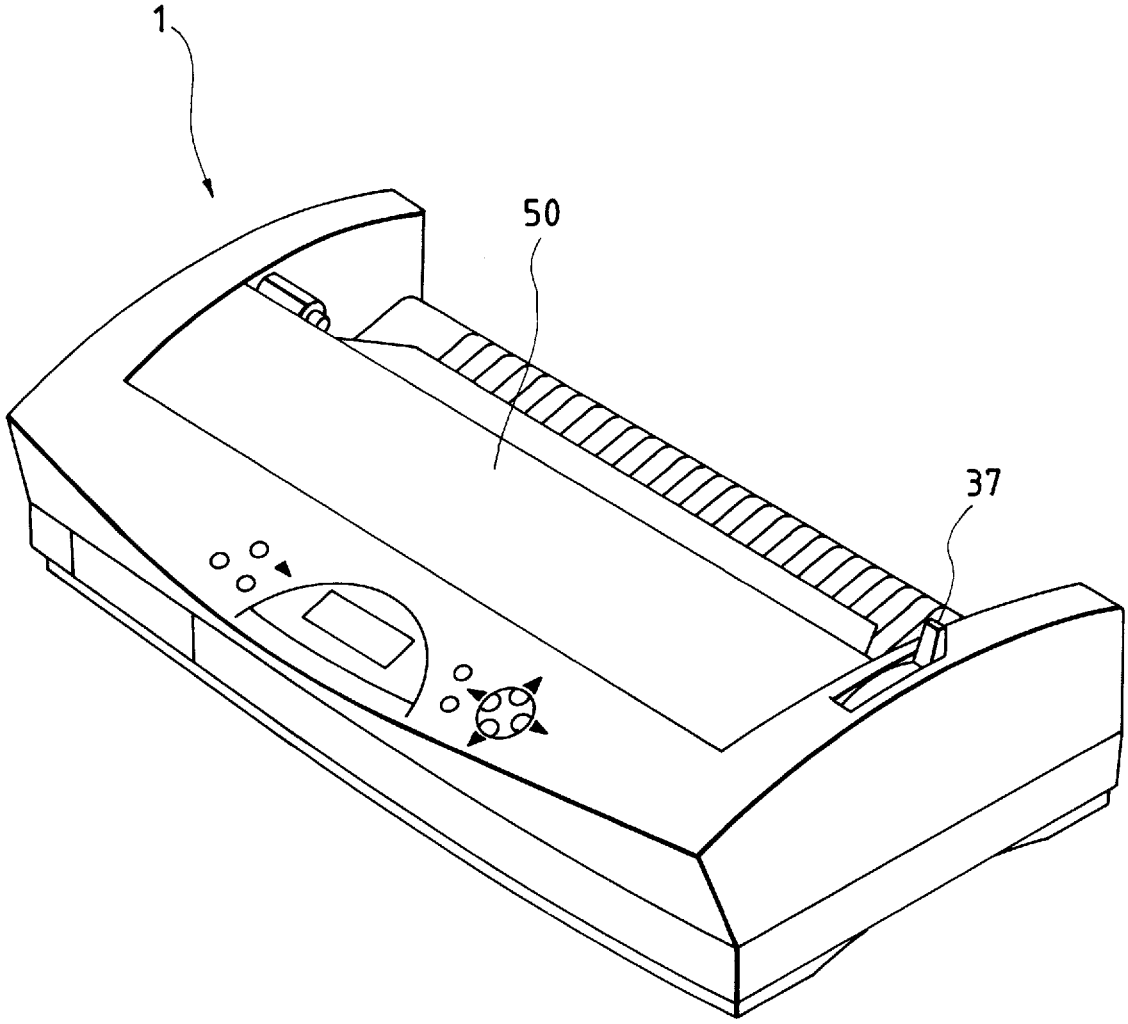
FIG. 1 is a perspective view of an ink jet recording apparatus as a recording apparatus according to a preferred embodiment of the present invention.

The present invention will now be explained in connection with a preferred embodiment thereof will reference to the accompanying drawings.

The recording apparatus according to the preferred embodiment is an ink jet recording apparatus in which the recording is effected by discharging ink from a recording means. In the ink jet recording apparatus 1, single sheet (referred to as "cut sheet" hereinafter) such as a plain sheet and a post card, or a continuous sheet such as a fan-fold sheet can be used as a recording medium.

Now, a main construction of the ink jet recording apparatus 1 will be explained with reference to FIG. 3. The ink jet recording apparatus includes an ink jet head (recording means) 20 for effecting the recording by discharging ink toward the recording medium, a convey roller (convey means) 10 for conveying the recording medium, a gap roller (first discharge means) 13 disposed in the vicinity of and a downstream side of the ink jet head 20 in a recording medium conveying direction, a discharge roller (second discharge means) 14 disposed a downstream side of the gap roller 13 in the recording medium conveying direction, spurs as rotary members (first and second auxiliary discharge means) 13*a,* 14*a* urged against the gap roller 13 and the discharge roller 14 at a first position, respectively, a spur cover 50 as a cover supported by the apparatus for an opening/closing movement, and a body frame (metal frame) 2 on which the gap roller 13, discharge roller 14 and convey roller 10 are rested.

Each spur is a wheel provided at its periphery with a plurality projections each having a sharp tip end so that the recording medium can be discharged (or conveyed) by one or more projections (with very small contact area). In the first position, the spur cover 50 is closed as shown.

The ink jet head 20 includes electro-thermal converters for generating the thermal energy causing the film boiling in the ink as elements for generating energy utilized to discharge the ink. With this arrangement, the discharging of the ink toward the recording medium is performed effectively, thereby obtaining a good recording result.

Figure 2:
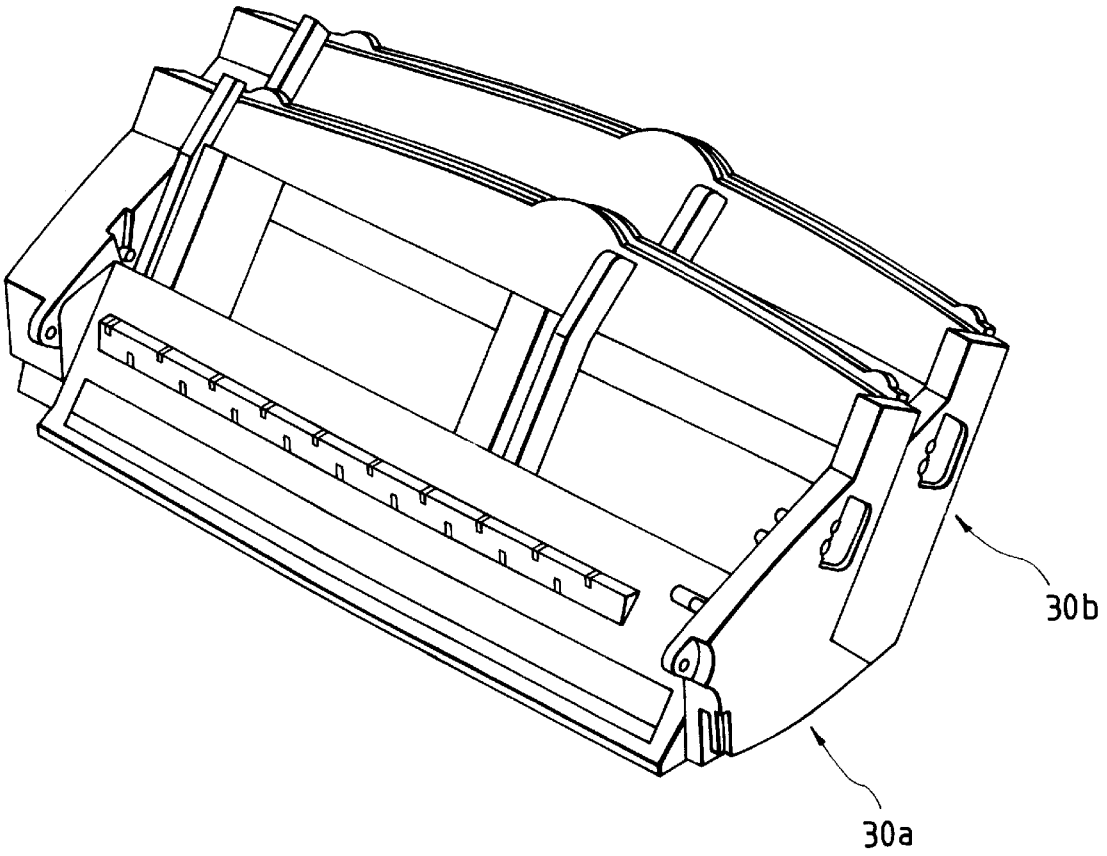
FIG. 2 is a perspective view of an automatic sheet supply unit mounted to the ink jet recording apparatus of FIG. 1.
Figure 3:
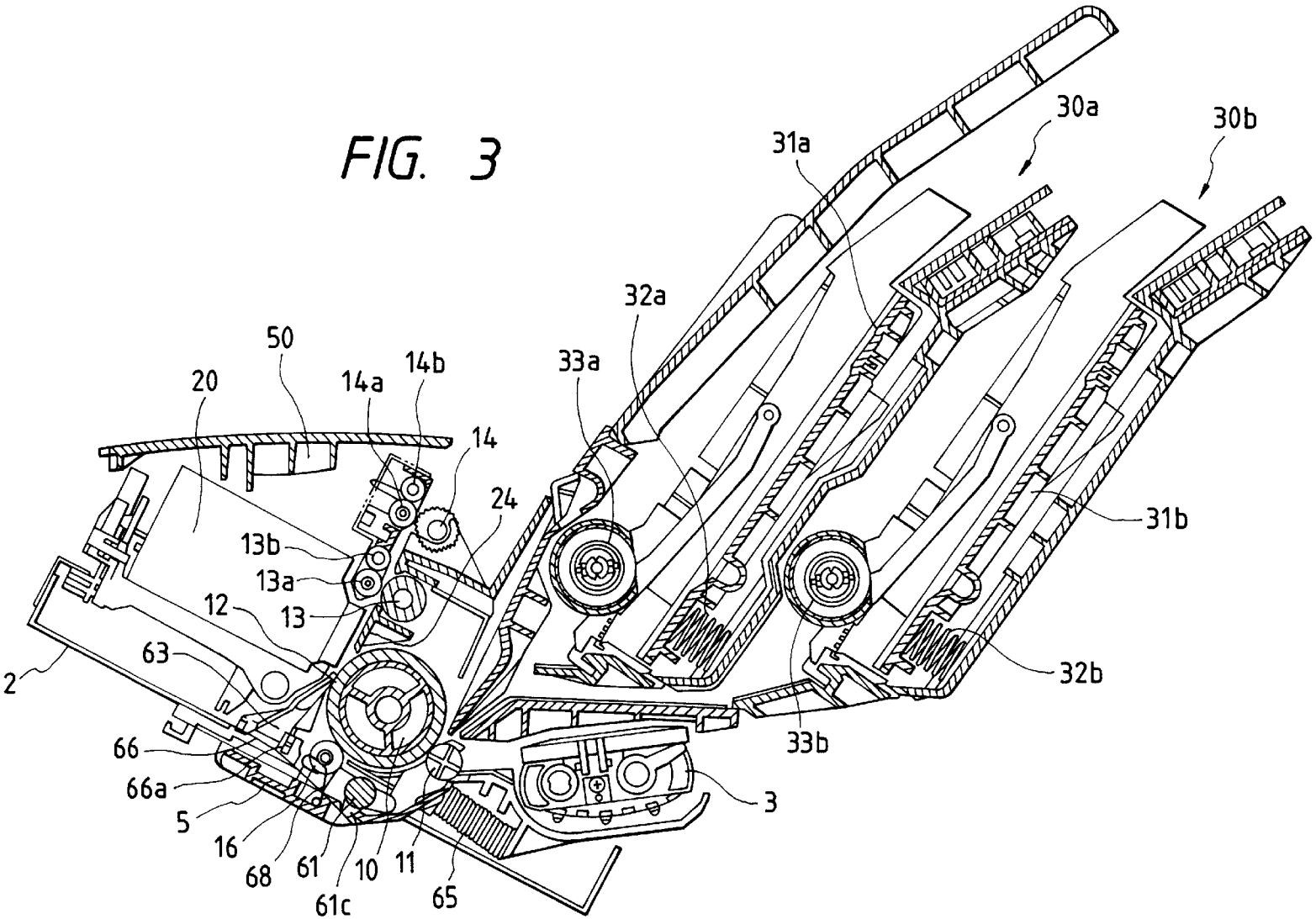
FIG. 3 is a sectional view showing a condition that the automatic sheet supply unit of FIG. 2 is mounted to the ink jet recording apparatus of FIG. 1.
Figure 4:
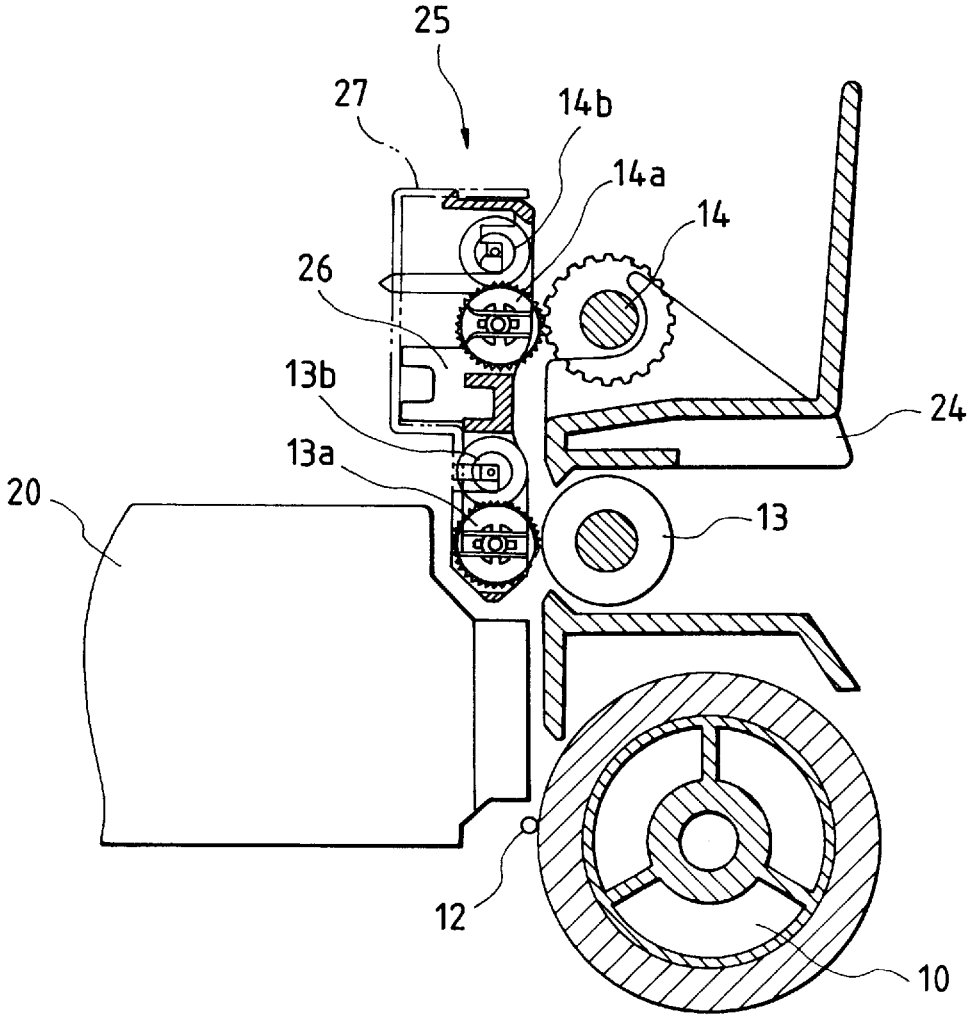
FIG. 4 is a sectional view of a spur portion shown in FIG. 3.

On the other hand, as can be seen from FIGS. 2 and 3, an ASF (automatic sheet feeder) can be constituted by two bins 30*a,* 30*b.* With this arrangement, the cut sheets having different sizes can be set simultaneously so that a desired cut sheet can be used by selection of an operator. The bins 30*a,* 30*b* have same sheet supply mechanisms. That is to say, a plurality of cut sheets (not shown in FIG. 3) stacked on urging plates 31*a,* 31*b* are urged toward pick-up rollers 33*a,* 33*b* by means of coil springs 32*a,* 32*b.* In response to a sheet supply command, the cut sheets are separated and supplied one by one by the rotating pick-up roller 33*a* or 33*b.*

In FIG. 3, in the case where the cut sheet is used, when a release lever 37 (FIG. 1) is set in a cut sheet selection condition, a pinch roller 11 held by a pinch roller holder 5 is urged against the convey roller 10 by a coil-shaped pinch roller spring 65. Similarly, an auxiliary roller 16 held by the pinch roller holder 5 for up-and-down movement is urged against the convey roller 10 by a plate-shaped auxiliary roller spring 68 provided on the pinch roller holder 5. As a result, the cut sheet supplied from the ASF is conveyed toward a recording position by rotation of the convey roller 10 along a convey path formed around the convey roller.

In the recording position, a needle roller 12 is held by a needle roller holder 63 and is urged against the convey roller 10 by a plate-shaped needle roller spring 66. In this case, the needle roller spring 66 is flexed by a projection 61*c* formed on a release shaft 61 to provide an urging force generated by an elastic spring force around a flexed point 66*a.* The cut sheet is further subjected to a conveying force, so that the cut sheet is conveyed between the ink jet head 20 and a platen 24. The conveyance of the cut sheet is effected intermittently at every scan of the ink jet head 20, and a convey amount corresponds to an arrangement length of a plurality of ink discharge openings in the cut sheet conveying direction.

The recording is effected by the conveyance of the cut sheet per scan of the head and the ink discharge from the head between the successive conveyances. The cut sheet on which the recording was effected is conveyed upwardly in the apparatus by means of the gap roller 13 and discharge roller 14 (and the spurs 13*a,* 14*a* urged against these rollers) and then is discharged by the spurs 14*a.*

A spur unit 25 is attached to a spur frame 27 via a spur holder 26 for rotatably holding the spurs 13*a,* 14*a.* The spur unit 25 is provided with discrete rotatable cleaners (cleaning means) 13*b,* 14*b* for removing ink adhered to the spurs 13*a,* 14*a,* respectively. With this arrangement, since the spurs 13*a,* 14*a* are cleaned, the ink is prevented from being re-transferred to the spurs, thereby preventing the deterioration of the recording quality. Further, the spurs 13*a,* 14*a* are biased toward the gap roller 13 and the discharge roller 14, respectively, by means of discrete springs (urging force applying means). As a result, the cut sheet can be conveyed positively.

Figure 5:
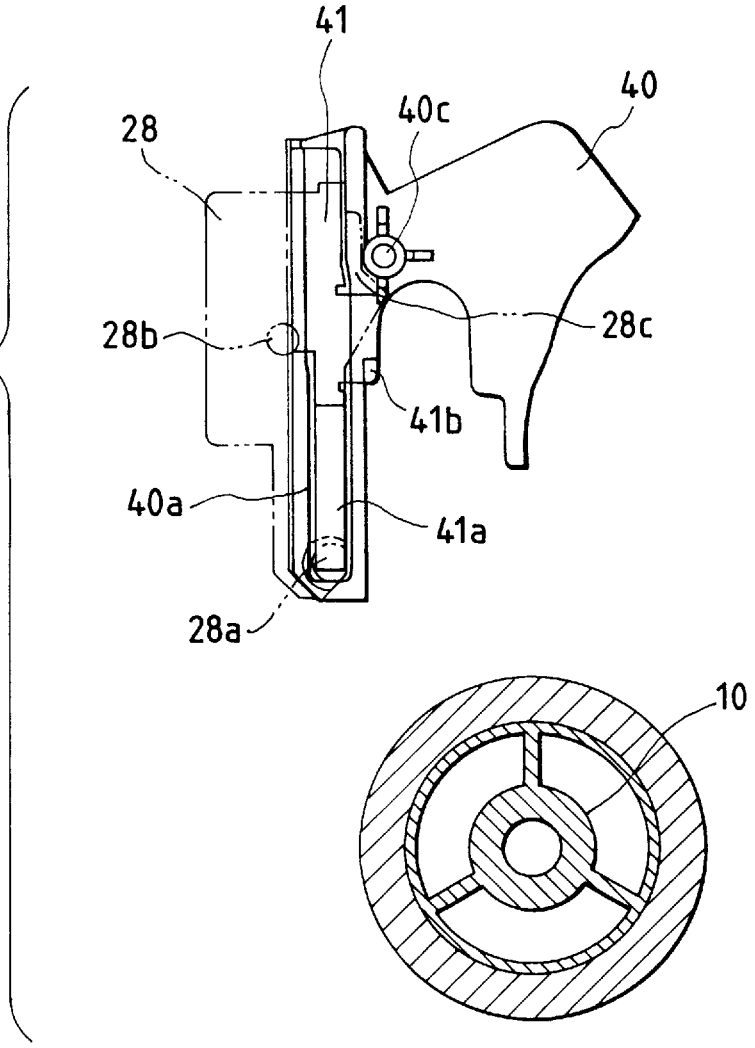
FIG. 5 is an explanatory view showing a relation between a spur unit and a guide member.

In a condition shown in FIG. 5, the position of the spur unit 25 is fixed by a frame cap 28 attached to the spur frame 27 in such a manner that a boss 28*a* of the cap is guided by a guide groove 40*a* of a guide member and a cover portion 28*c* abuts against a boss 40*c* of the guide member 40.

Figure 6:
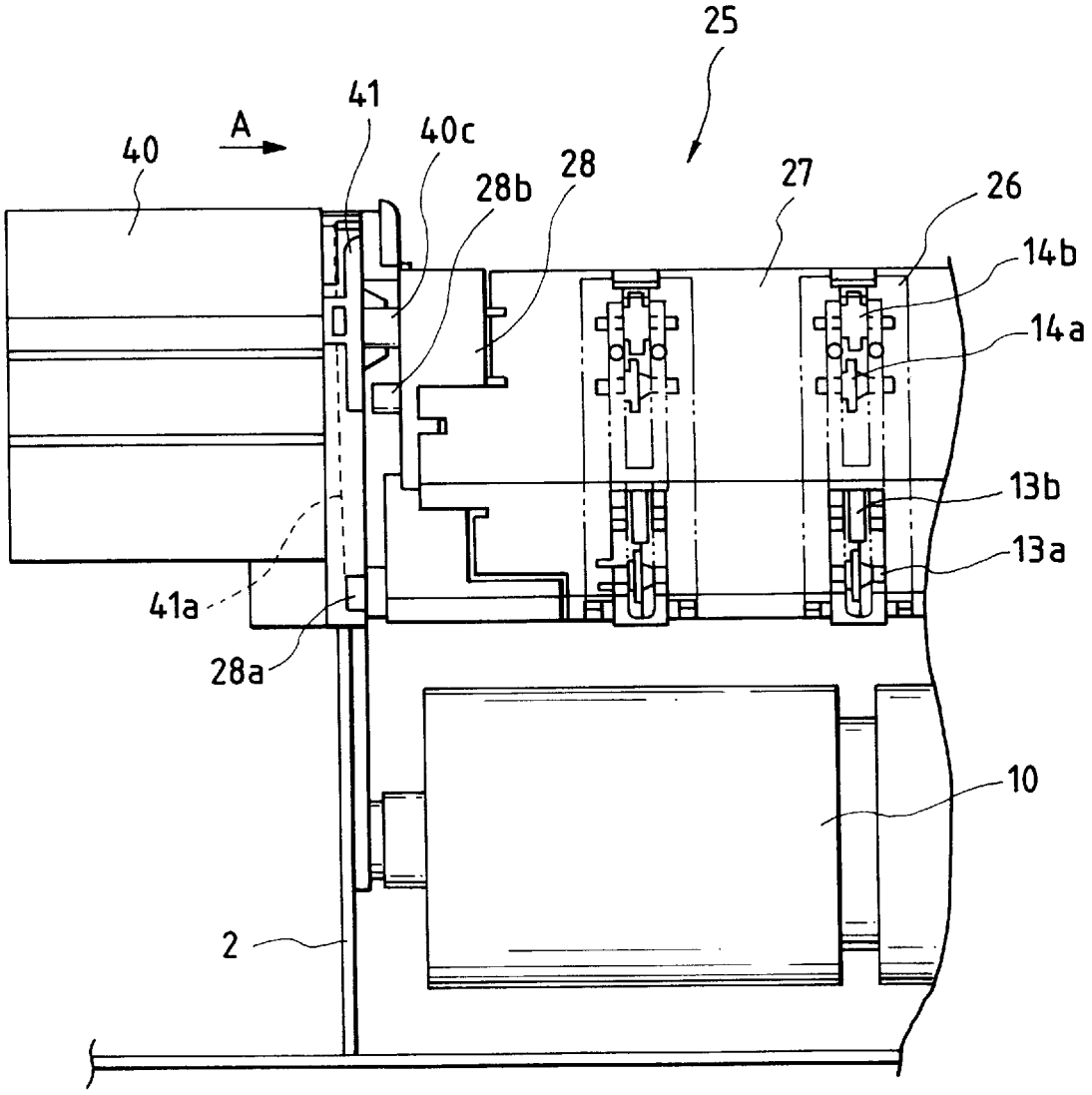
FIG. 6 is an explanatory view showing a front position of FIGS. 4 and 5.

The guide member 40 is provided with an earth plate 41 for providing a biasing force directing toward a direction shown by the arrow A in FIG. 6. A contact piece 41*a* of the earth plate 41 is urged against the boss 28*a* of the frame cap 28 by the biasing force, and a contact piece 41*b* of the earth plate 41 is contacted with the body frame 2. That is to say, by forming the body frame 2, spur frame 27, frame cap 28 and earth plate 41 from high conductive material (for example, metal), static electricity generated in the sheet convey system can be removed.

Figure 7:
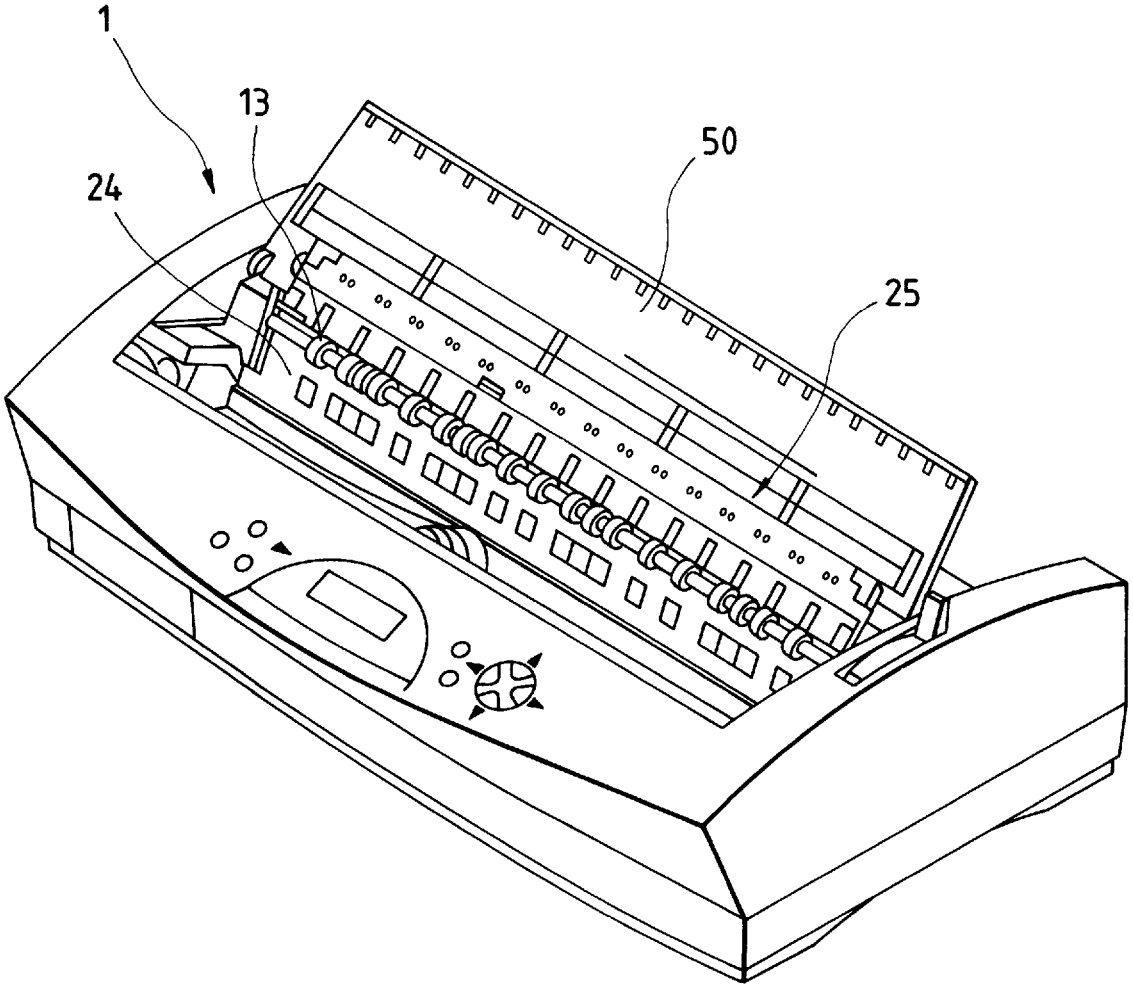
FIG. 7 is a perspective view showing a condition that a spur cover of the ink jet recording apparatus of FIG. 1 is fully opened.
Figure 8:
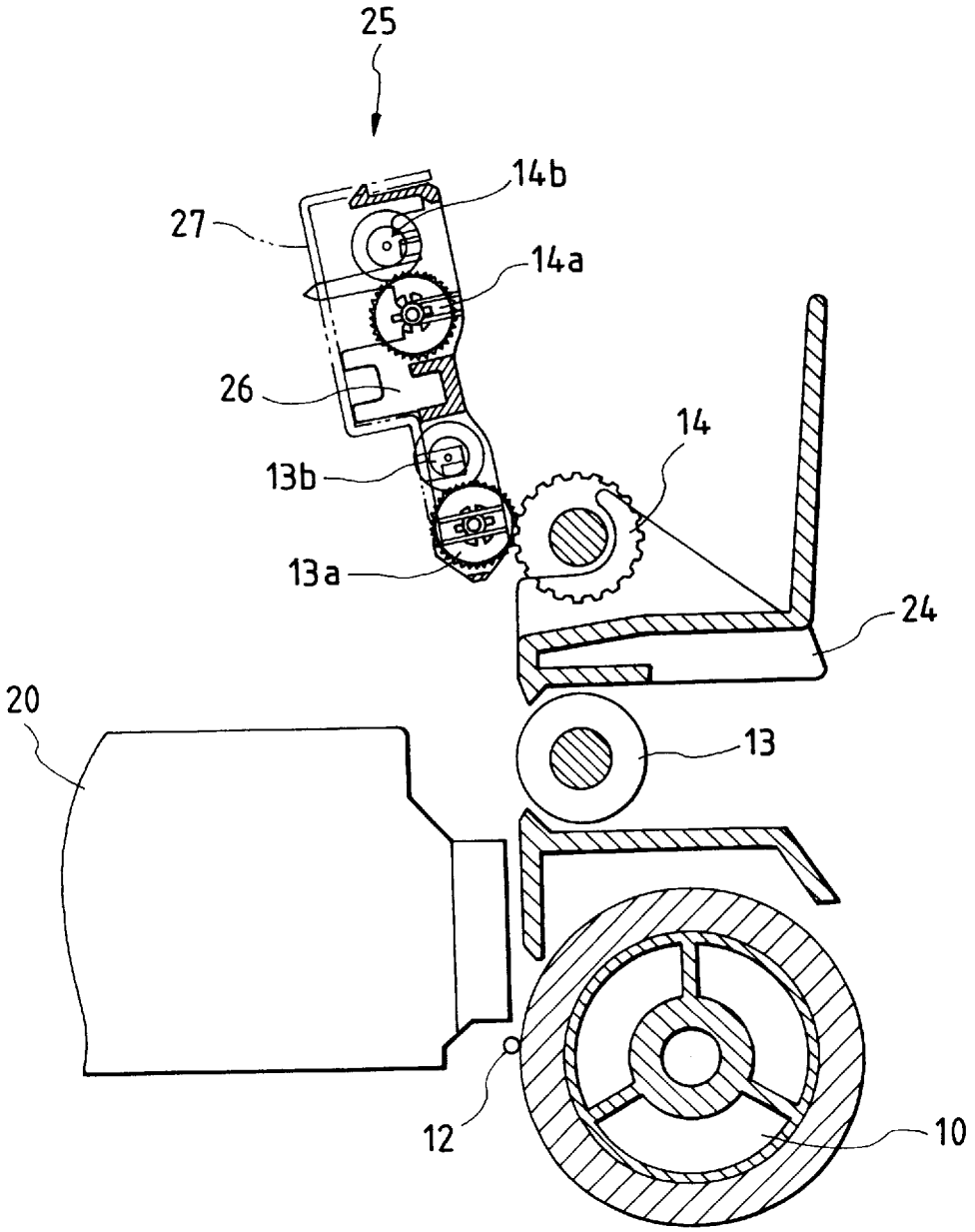
FIG. 8 is a sectional view showing a spur portion of FIG. 7 in detail.
Figure 9:
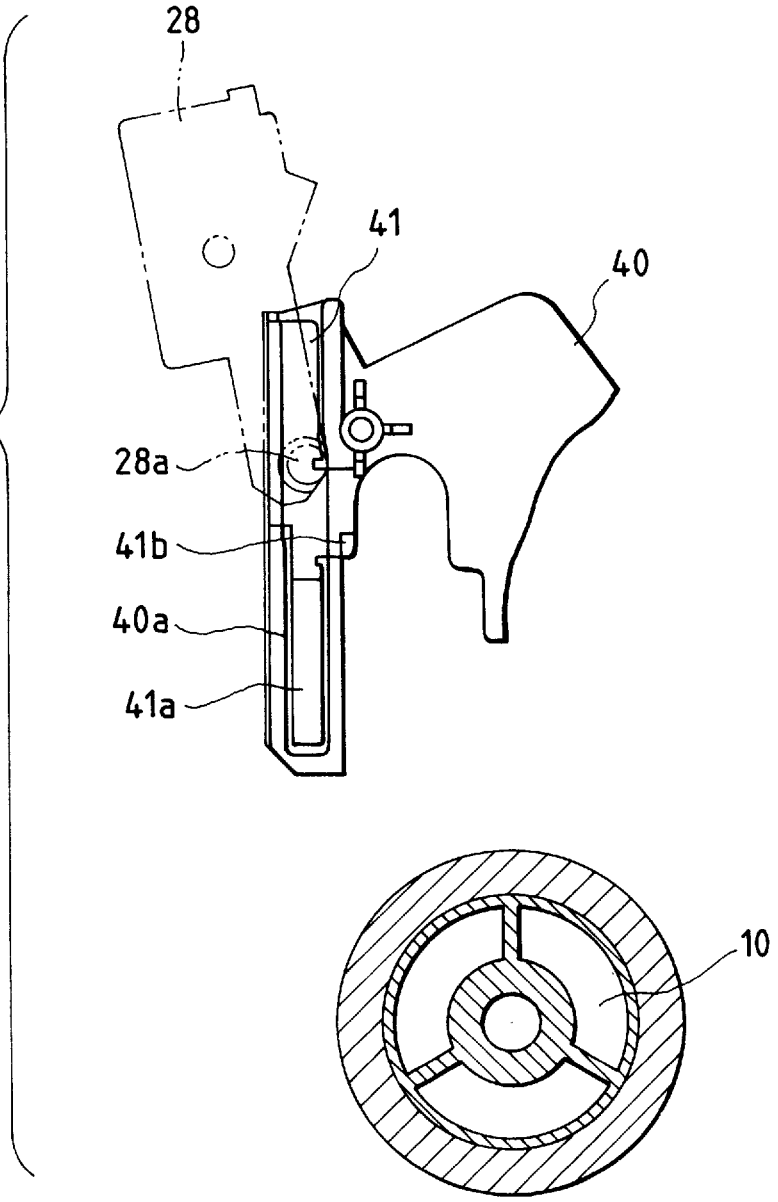
FIG. 9 is an explanatory view showing a relation between a spur unit and a guide member.
Figure 10:
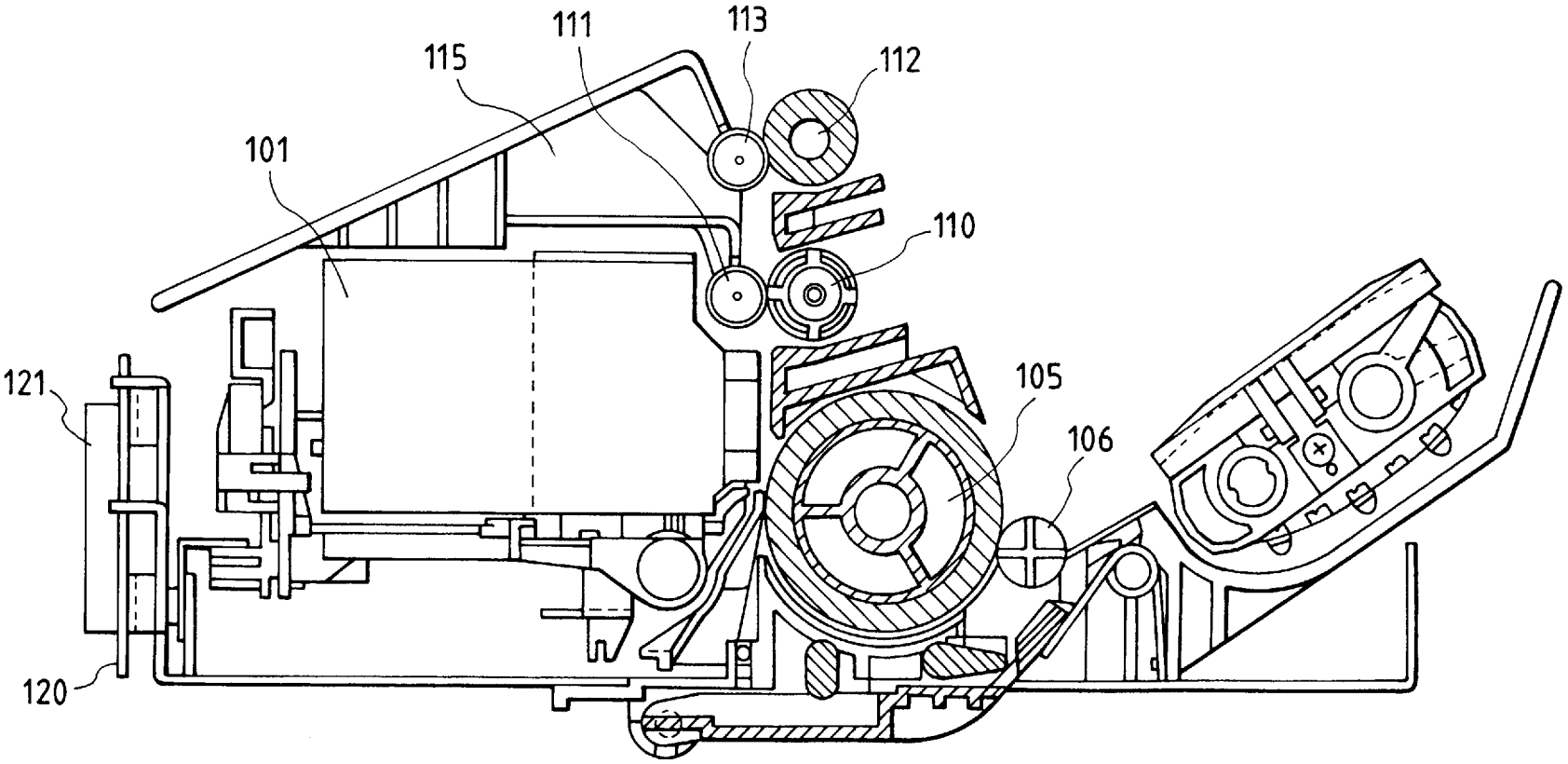
FIG. 10 is a sectional view of a conventional ink jet recording apparatus.
Figure 11:
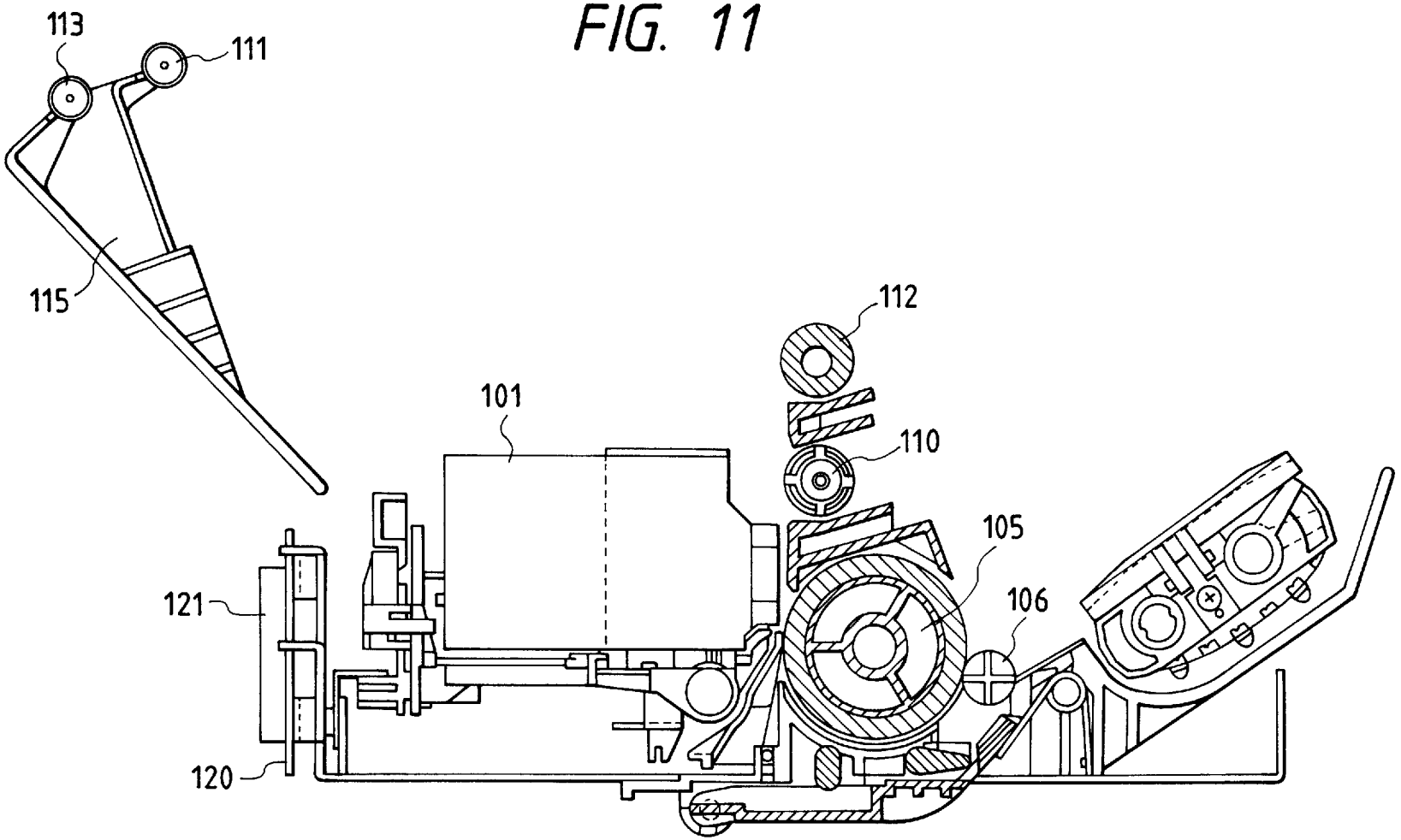
FIG. 11 is a sectional view showing a condition that a cover of the ink jet recording apparatus of FIG. 10 is opened by a certain angle.

Since the spur cover 50 is connected to the boss 28*b* of the frame cap 28 shown in FIG. 5, the spur unit 25 is shifted in synchronous with the opening/closing movement of the spur cover 50. The shifting movement of the spur unit is regulated by the guide groove 40*a* of the guide member 40 and the boss 28*a* of the frame cap 28. In FIGS. 7 to 9, when the spur cover 50 is fully opened, the spur unit 25 is shifted along the guide groove 40*a* of the guide member 40 to reach a second position (FIG. 8) where the spurs 13*a* of the spur unit 25 are urged against the discharge roller 14, thereby providing the conveying force. Accordingly, even in the condition that the spur cover 50 is fully opened, the conveyance of the recording medium (cut sheet or continuous sheet) and the recording to the recording medium can be effected.

In this way, since the spur unit 25 is brought to the second position in synchronous with the spur cover 50, the operability can be improved.

Further, as shown in FIGS. 5 and 9, the guide groove 40*a* of the guide member 40 for guiding the spur unit 25 extends in a direction substantially parallel with the recording medium conveying direction. As a result, even when the spur cover 50 is fully opened during the recording operation, a bad influence is not affected upon the conveyance of the recording medium, thereby obtaining the good recording result. On the other hand, the boss 28*a* of the frame cap 28 is contacted with another earth plate 41*b* so that the static electricity can be removed, similar to the closed condition (first position) of the spur cover 50.

Incidentally, in the illustrated embodiment, while an example that the recording means discharges the ink was explained, the recording means is not limited to the ink jet recording means, but, a wire dot recording means, a heat-sensitive recording means, a heat-transfer recording means or a laser beam recording means may be used.

As mentioned above, according to the present invention, since the first auxiliary discharge means is urged against the second discharge means at the second position, when the condition that the cover is opened is assumed to the second position, also in the condition that the cover is opened, the recording medium can be conveyed by the second discharge means and the first auxiliary discharge means, regardless of the kind of the recording medium. By providing the guide member for shifting the first auxiliary discharge means from the first position to the second position in the direction substantially parallel to the recording medium conveying direction, even when the cover is opened, a bad influence is not affected upon the conveyance of the recording medium, thereby obtaining the good recording result.

Further, by providing the holding means adapted to rotatably hold the first and second auxiliary discharge means and operated in synchronous with the cover pivotally supported by the recording apparatus, when the cover is opened, since the second position is obtained by the holding means in synchronous with the cover, the operability is improved. In addition, since the metal frame on which the first and second discharge means and the convey means are rested is provided, and the holding means and the metal frame are electrically connected to each other through the guide member both in the first and second positions, even when the cover is opened, the electrical stability of the holding means driven in synchronous with the opening movement of the cover can be ensured.

In addition, since the urging force applying means for urging the first and second auxiliary discharge means against the first and second discharge means, independently, are provided, the first and second auxiliary discharge means can surely convey the recording medium in the first and second positions.

Further, since the first and second auxiliary discharge means comprise rotary members, respectively, and are cleaned by the corresponding cleaning means independently, even when the recording means effects the recording by discharging the ink toward the recording medium, the ink is not re-transferred to the recording medium, thereby preventing the deterioration of the recording quality. In addition, since the recording means includes the electro-thermal converter for generating the thermal energy causing the film boiling in the ink as the element for generating energy utilized to discharge the ink, the discharging of the ink toward the recording medium is performed effectively, thereby obtaining a good recording result.

What is claimed is:

1. A recording apparatus comprising:

recording means for effecting a recording on a recording medium;

convey means for conveying the recording medium disposed upstream from said recording means in a recording medium conveying direction, said conveying means conveying the recording medium to and past said recording means;

first discharge means for discharging the recording medium disposed downstream of said recording means in a recording medium conveying direction adjacent thereto;

second discharge means for discharging the recording medium disposed downstream of said first discharge means in the recording medium conveying direction; and first auxiliary discharge means for discharging the recording medium and second auxiliary discharge means for discharging the recording medium disposed downstream from said recording means in a recording medium conveying direction, wherein said first and said second auxiliary discharge means are urged against said first discharge means and second discharge means, respectively, at a respective first position thereto, wherein said first auxiliary discharge means is substantially urged against said second discharge means at a second position thereof and wherein said second auxiliary discharge means is separated away from said second discharge means at a second position thereof.

2. A recording apparatus according to claim 1, further comprising a guide member for shifting said first auxiliary discharge means from the first position to the second position in a direction substantially parallel to the recording medium conveying direction.

3. A recording apparatus according to claim 2, wherein each of said first and second auxiliary discharge means includes an independent urging force applying means for urging said first and second auxiliary means against said first and second discharge means, respectively.

4. A recording apparatus according to claims 1, 2 or 3, wherein said recording means records onto the recording medium by discharging an ink.

5. A recording apparatus according to claim 4, wherein each of said first and second auxiliary discharge means comprises a rotary member, and wherein said recording apparatus further comprises for each rotary member a corresponding cleaning means for cleaning each said rotary member located adjacent thereto.

6. A recording apparatus according to claim 4, wherein said recording means includes an electro-thermal converter for generating thermal energy causing film boiling in the ink, as an element for generating energy to discharge the ink.

7. A recording apparatus according to claim 5, wherein said recording means includes an electro-thermal converter for generating thermal energy causing film boiling in the ink, as an element for generating energy utilized to discharge the ink.

8. A recording apparatus comprising:

recording means for effecting a recording on a recording medium;

a conveying means for conveying the recording medium disposed upstream from said recording means in a recording medium conveying direction, said conveying means conveying the recording medium to and past said recording means;

a first discharge means for discharging the recording medium disposed downstream of said recording means in a recording medium conveying direction adjacent thereto;

a second discharge means for discharging the recording medium disposed downstream of said fist discharge means in the recording medium conveying direction;

first auxiliary discharge means for discharging the recording medium and second auxiliary discharge means for discharging the recording medium disposed downstream from said recording means in a recording medium conveying direction, wherein said first and said second auxiliary discharge means are urged against said first discharge means and second discharge means, respectively, at a first position and wherein said first auxiliary discharge means is substantially urged against said second discharge means at a second position;

a guide member for shifting said first auxiliary discharge means from the first position to the second position in a direction substantially parallel to the recording medium conveying direction; and a cover adjacent said first and said second auxiliary discharge means for opening and closing relative thereto; and holding means for rotatably holding said first and said second auxiliary discharge means operated in synchronism with said cover.

9. A recording apparatus according to claim 8, wherein each of said first and second auxiliary discharge means includes an independent urging force applying means for urging said first and second auxiliary discharge means against said first and second discharge means, respectively.

10. A recording apparatus according to claim 8 or 9, wherein said recording means is of type in which the recording to the recording medium is effected by discharging an ink.

11. A recording apparatus according to claim 10, wherein each of said first and second auxiliary discharge means comprises a rotary member, and wherein said recording apparatus further comprises for each rotary member a corresponding cleaning means for cleaning each said rotary member located adjacent thereto.

12. A recording apparatus according to claim 10, wherein said recording means includes an electro-thermal converter for generating thermal energy causing film boiling in the ink as an element for generating energy to discharge the ink.

13. A recording apparatus according to claim 11, wherein said recording means includes an electro-thermal converter for generating thermal energy causing film boiling in the ink as an element for generating energy to discharge the ink.

14. A recording apparatus comprising:

recording means for effecting a recording on a recording medium;

convey means for conveying the recording medium disposed upstream from said recording means in a recording medium conveying direction, said conveying means conveying the recording medium to and past said recording means;

first discharge means for discharging the recording medium disposed downstream of said recording means in a recording medium conveying direction adjacent thereto;

second discharge means for discharging the recording medium disposed downstream of said first discharge means in the recording medium conveying direction;

first auxiliary discharge means for discharging the recording medium and second auxiliary discharge means for discharging the recording medium disposed downstream from said recording means in a recording medium conveying direction, wherein said first and said second auxiliary discharge means are urged against said first discharge means and second discharge means, respectively, at a first position, and wherein said first auxiliary discharge means is substantially urged against said second discharge means at a second position;

a guide member for shifting said first auxiliary discharge means from the first position to the second position in a direction substantially parallel to the recording medium conveying direction;

a cover adjacent said first and said second auxiliary discharge means for opening and closing relative thereto;

a holding means for rotatably holding said first and said second auxiliary discharge means operated in synchronism with said cover; and a metal frame on which said first and second discharge means and said conveying means are rested wherein said holding means and said metal frame are electrically connected to each other through said guide member in both the first and second positions.

15. A recording apparatus according to claim 14, wherein each of said first and second auxiliary discharge means includes an independent urging force applying means for urging said first and second auxiliary discharge means against said first and second discharge means, respectively.

16. A recording apparatus according to claim 14 or 15, wherein said recording means is of type in which the recording to the recording medium is effected by discharging an ink.

17. A recording apparatus according to claim 16, further comprising a cleaning means for cleaning said first and second auxiliary discharge means, wherein each of said first and second auxiliary discharge means comprises a rotary member, said rotary member being cleaned by said cleaning means located adjacent thereto.

18. A recording apparatus according to claim 16, wherein said recording means includes an electro-thermal converter for generating thermal energy causing film boiling in the ink as an element for generating energy to discharge the ink.

19. A recording apparatus according to claim 17, wherein said recording means includes an electro-thermal converter for generating thermal energy causing film boiling in the ink as an element for generating energy to discharge the ink.

* * * * *

UNITED STATES PATENT AND TRADEMARK OFFICE

CERTIFICATE OF CORRECTION

PATENT NO. : 5,870,127

DATED : February 9, 1999

INVENTOR(S) : YASUSHI KOIKE, ET AL.

It is certified that error appears in the above-identified patent and that said Letters Patent is hereby corrected as shown below:

AT [57] ABSTRACT

Line 1, "a" should be deleted.

COLUMN 2

Line 4, "plurality" should read --plurality of--;
Line 13, "with interfere with" should read --interfere with--; and
Line 51, "synchronous" should read --synchronism--.

COLUMN 3

Line 40, "synchronous" should read --synchronism--.

COLUMN 4

Line 12, "comprising" should read --comprises--; and
Line 49, "synchronous" should read --synchronism--.

COLUMN 5

Line 48, "will" should read --with--; and
Line 67, "disposed" should read --disposed on--.

COLUMN 6

Line 10, "plurality" should read --plurality of--.

COLUMN 7

Line 24, "synchronous" should read --synchronism--;
Line 37, "synchronous" should read --synchronism--; and
Line 45, "affected" should read --effected--.

UNITED STATES PATENT AND TRADEMARK OFFICE

CERTIFICATE OF CORRECTION

PATENT NO. : 5,870,127

DATED : February 9, 1999

INVENTOR(S) : YASUSHI KOIKE, ET AL.

It is certified that error appears in the above-identified patent and that said Letters Patent is hereby corrected as shown below:

COLUMN 8

Line 6, "synchronous" should read --synchronism--;
Line 9, "synchronous" should read --synchronism--; and
Line 15, "synchronous" should read --synchronism--.

Signed and Sealed this

Sixteenth Day of May, 2000

*Attest:*

Q. TODD DICKINSON

*Attesting Officer*

*Director of Patents and Trademarks*